US011713856B2

(12) United States Patent
He

(10) Patent No.: US 11,713,856 B2
(45) Date of Patent: Aug. 1, 2023

(54) LIGHTING LAMP

(71) Applicants: SUZHOU OPPLE LIGHTING CO., LTD., Suzhou (CN); OPPLE LIGHTING CO., LTD., Shanghai (CN)

(72) Inventor: Jianzhi He, Suzhou (CN)

(73) Assignees: Suzhou Opple Lighting Co., Ltd., Suzhou (CN); Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 17/848,252

(22) Filed: Jun. 23, 2022

(65) Prior Publication Data

US 2022/0316672 A1 Oct. 6, 2022

Related U.S. Application Data

(63) Continuation of application No. PCT/CN2020/138608, filed on Dec. 23, 2020.

(30) Foreign Application Priority Data

Dec. 24, 2019 (CN) ..... 201911350954.4
Dec. 24, 2019 (CN) ..... 201922351062.8

(51) Int. Cl.
*F21S 8/06* (2006.01)
*F21Y 115/10* (2016.01)

(52) U.S. Cl.
CPC ..... *F21S 8/068* (2013.01); *F21Y 2115/10* (2016.08)

(58) Field of Classification Search
CPC .. F21S 8/068; F21S 8/06; F21V 21/14; F21V 21/112
See application file for complete search history.

(56) References Cited

FOREIGN PATENT DOCUMENTS

| | | | |
|---|---|---|---|
| CN | 106969303 | A | 7/2017 |
| CN | 107438737 | A | 12/2017 |
| CN | 207438373 | U | 12/2017 |
| CN | 209341065 | U | 9/2019 |
| CN | 110906229 | A | 3/2020 |
| CN | 210860854 | U | 6/2020 |
| JP | 5588488 | B2 | 9/2014 |

OTHER PUBLICATIONS

International Search Report of PCT Application No. PCT/CN2020/138608 dated Mar. 22, 2021 with English translation, (5p).

*Primary Examiner* — Karabi Guharay
(74) *Attorney, Agent, or Firm* — Arch & Lake LLP

(57) ABSTRACT

The present disclosure provides a lighting lamp. The lighting lamp includes a lamp body and the lamp body is provided with a strip-shaped adjusting hole, an extending direction of the strip-shaped adjusting hole is perpendicular to an extending direction of the suspension wire, the adjusting component includes a supporting member and a locking member, a first end of the supporting member and the lamp body are slidingly fitted with each other along the extending direction of the strip-shaped adjusting hole, a second end of the supporting member passes through the strip-shaped adjusting hole and is movably connected with the locking member, a lamp body clamping space is formed between the first end of the supporting member and the locking member, one end of the suspension wire is connected to the fixing portion, and the other end of the suspension wire is connected to the supporting member.

13 Claims, 10 Drawing Sheets

LIGHTING LAMP

CROSS-REFERENCE TO RELATED APPLICATIONS

This application is based upon and claims the priority of PCT patent application No. PCT/CN2020/138608 filed on Dec. 23, 2020 which claims priority to the Chinese patent application No. 201911350954.4 filed on Dec. 24, 2019, and the Chinese patent application No. 201922351062.8 filed on Dec. 24, 2019, the entire contents of which are hereby incorporated by reference herein for all purposes.

TECHNICAL FIELD

The present disclosure relates to lighting technology field, in particular to a lighting lamp.

BACKGROUND

As lighting devices, lighting lamps have been widely used in people's daily life and work. With the continuous improvement of the quality of life, people have put forward higher requirements for the structure, performance, appearance, and the like of the lighting lamp, which brings a challenge to the design of the lighting lamp.

SUMMARY

The disclosure provides a lighting lamp.

The lighting lamp includes a fixing portion, a suspension wire, a lamp body and an adjusting component. The lamp body may be provided with a strip-shaped adjusting hole, an extending direction of the strip-shaped adjusting hole may be perpendicular to an extending direction of the suspension wire, the adjusting component may include a supporting member and a locking member, a first end of the supporting member and the lamp body may be slidingly fitted with each other along the extending direction of the strip-shaped adjusting hole, a second end of the supporting member may pass through the strip-shaped adjusting hole and may be movably connected with the locking member, a lamp body clamping space may be formed between the first end of the supporting member and the locking member, one end of the suspension wire may be connected to the fixing portion, and the other end of the suspension wire may be connected to the supporting member.

It is to be understood that both the foregoing general description and the following detailed description are exemplary and explanatory only and are not restrictive of the present disclosure.

BRIEF DESCRIPTION OF THE DRAWINGS

The accompanying drawings illustrated herein serve to provide a further understanding of the present disclosure and constitute a part of the present disclosure. The examples of the present disclosure and the descriptions thereof serve to explain the present disclosure and do not unduly limit the present disclosure. In the drawings.

DETAILED DESCRIPTION

Figure 1:
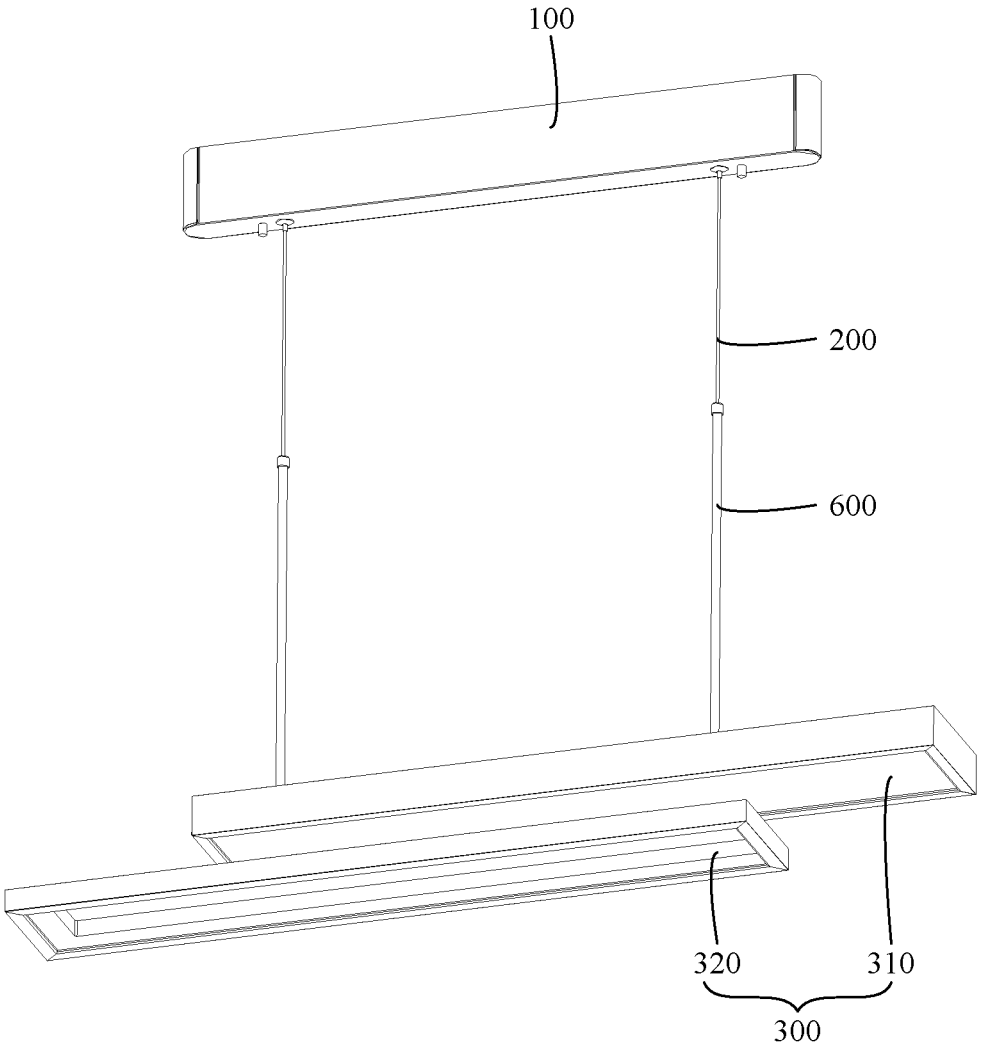
FIG. 1 is a schematic diagram of the structure of a lighting lamp according to examples of the present disclosure.
Figure 2:
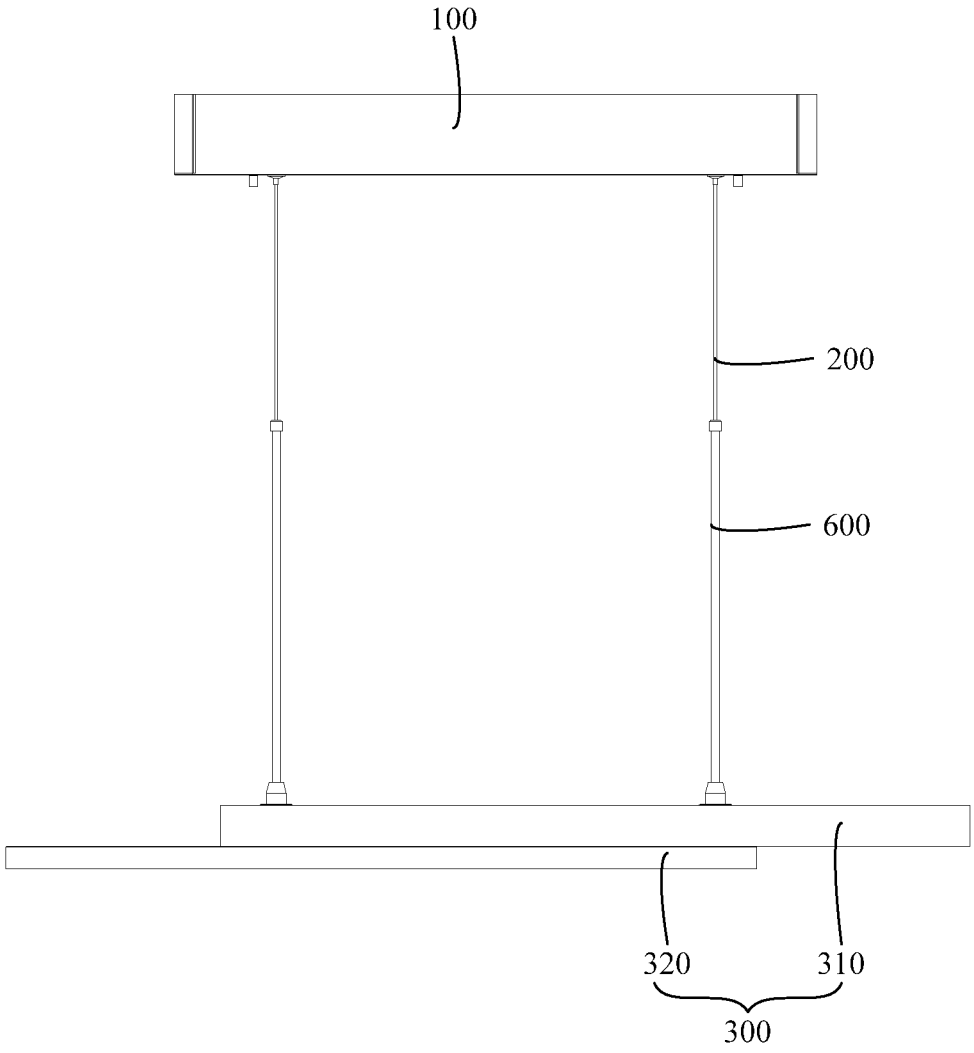
FIG. 2 is a schematic diagram of a front view of the lighting lamp according to the examples of the present disclosure.
Figure 3:
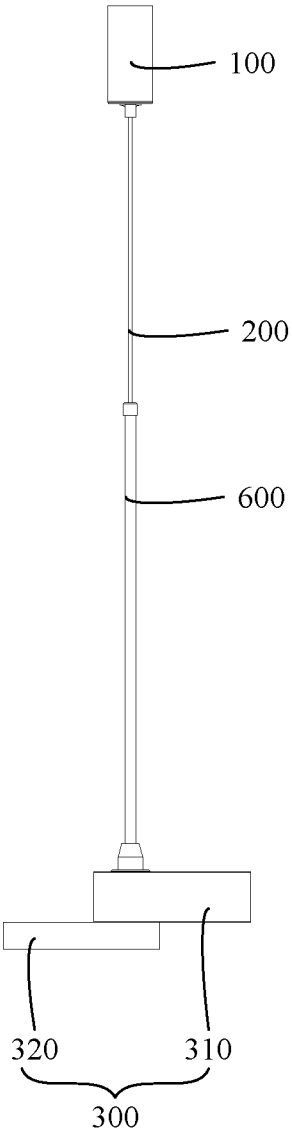
FIG. 3 is a schematic diagram of a side view of the lighting lamp according to the examples of the present disclosure.
Figure 4:
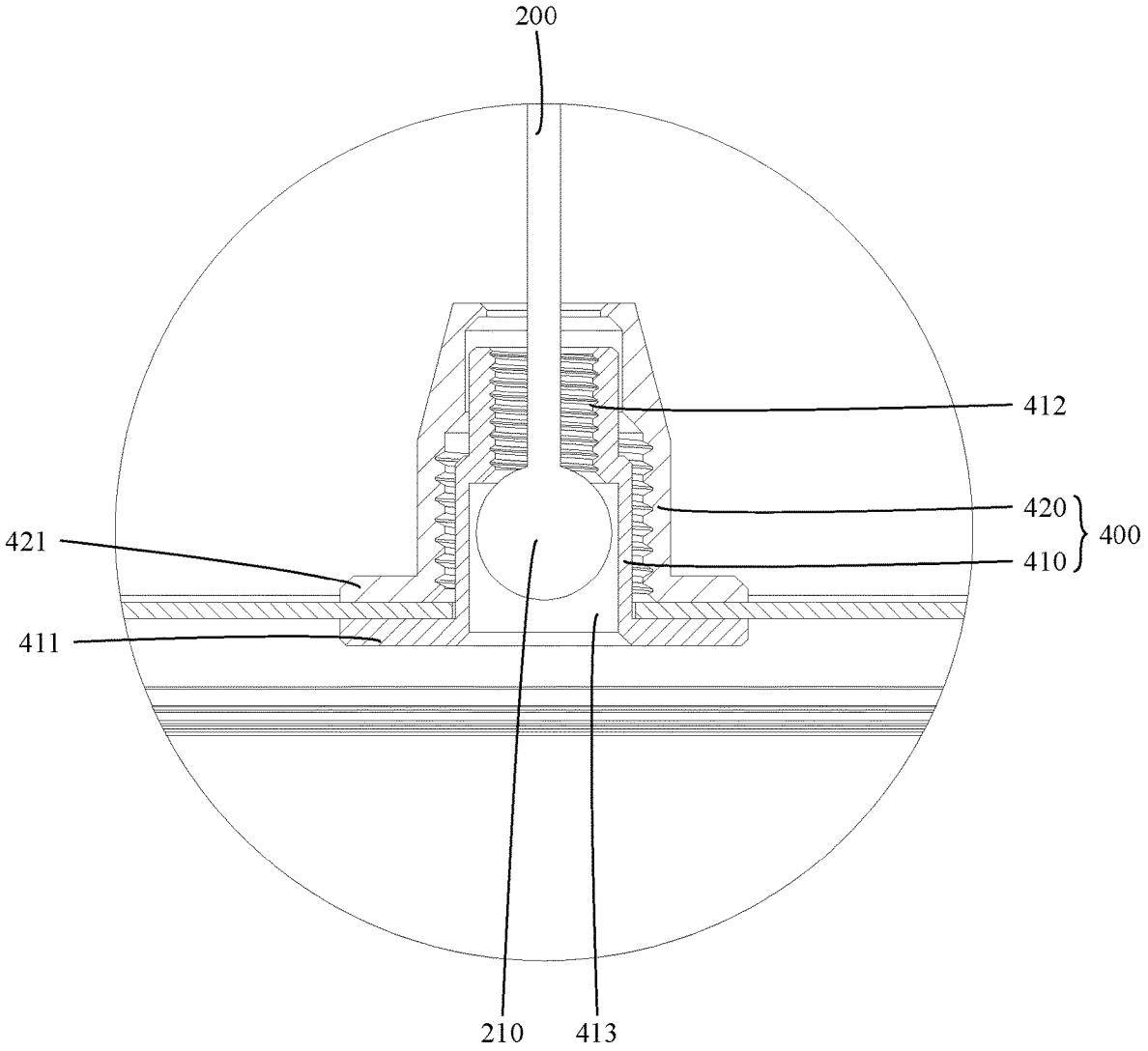
FIG. 4 to FIG. 8 are schematic diagrams of partial cross-sectional views of the lighting lamps in different states.
Figure 5:
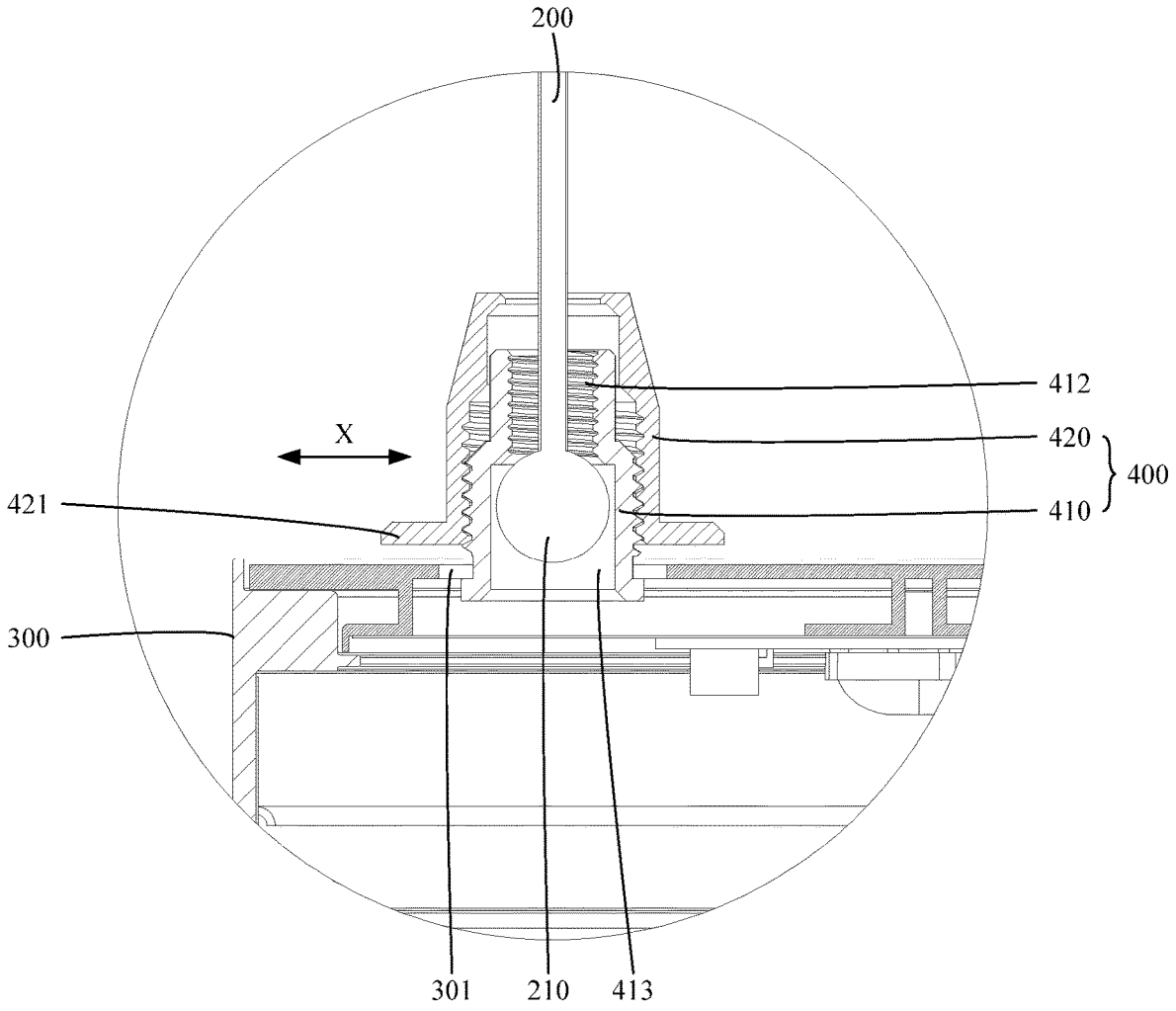
Figure 6:
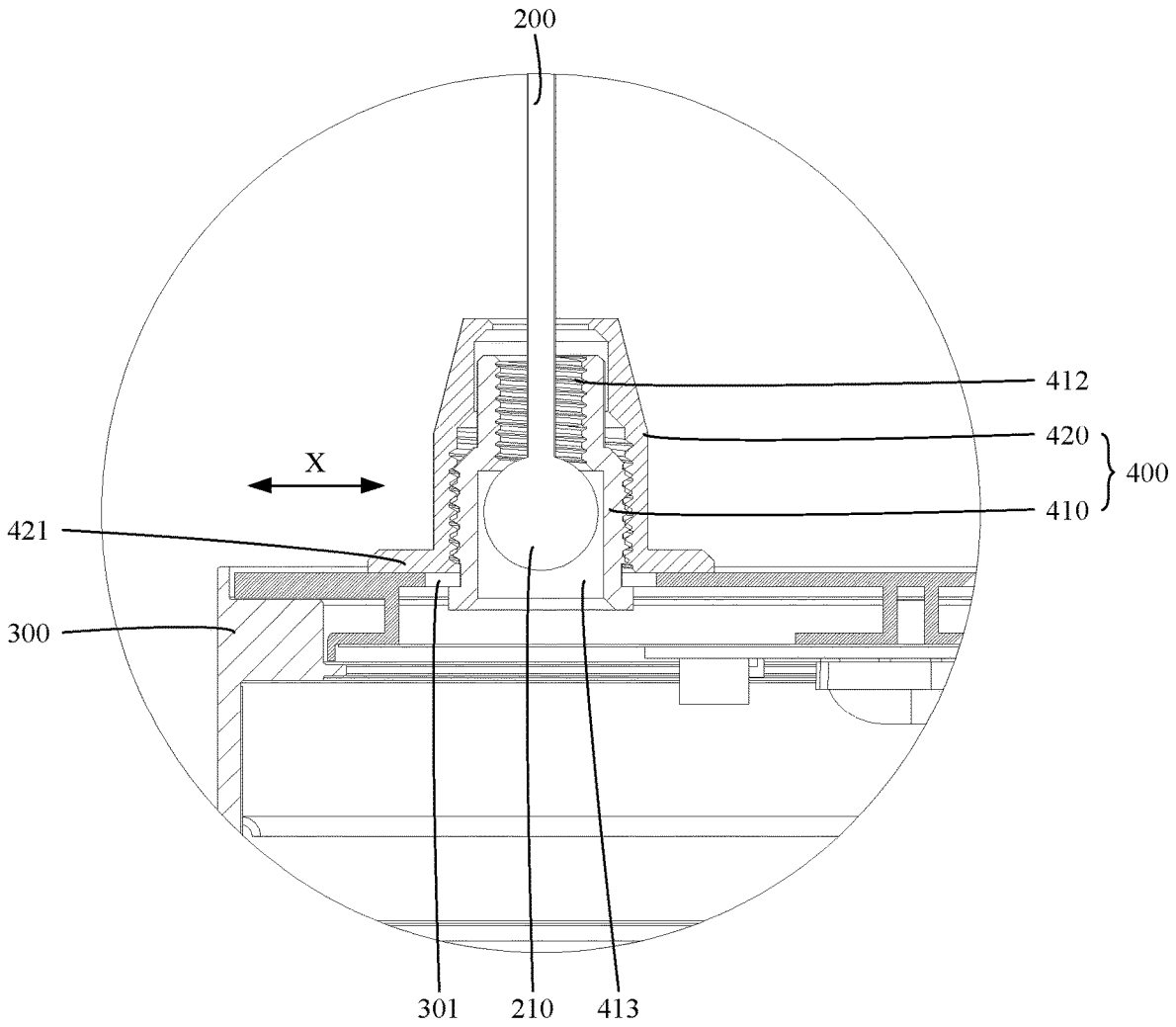
Figure 7:
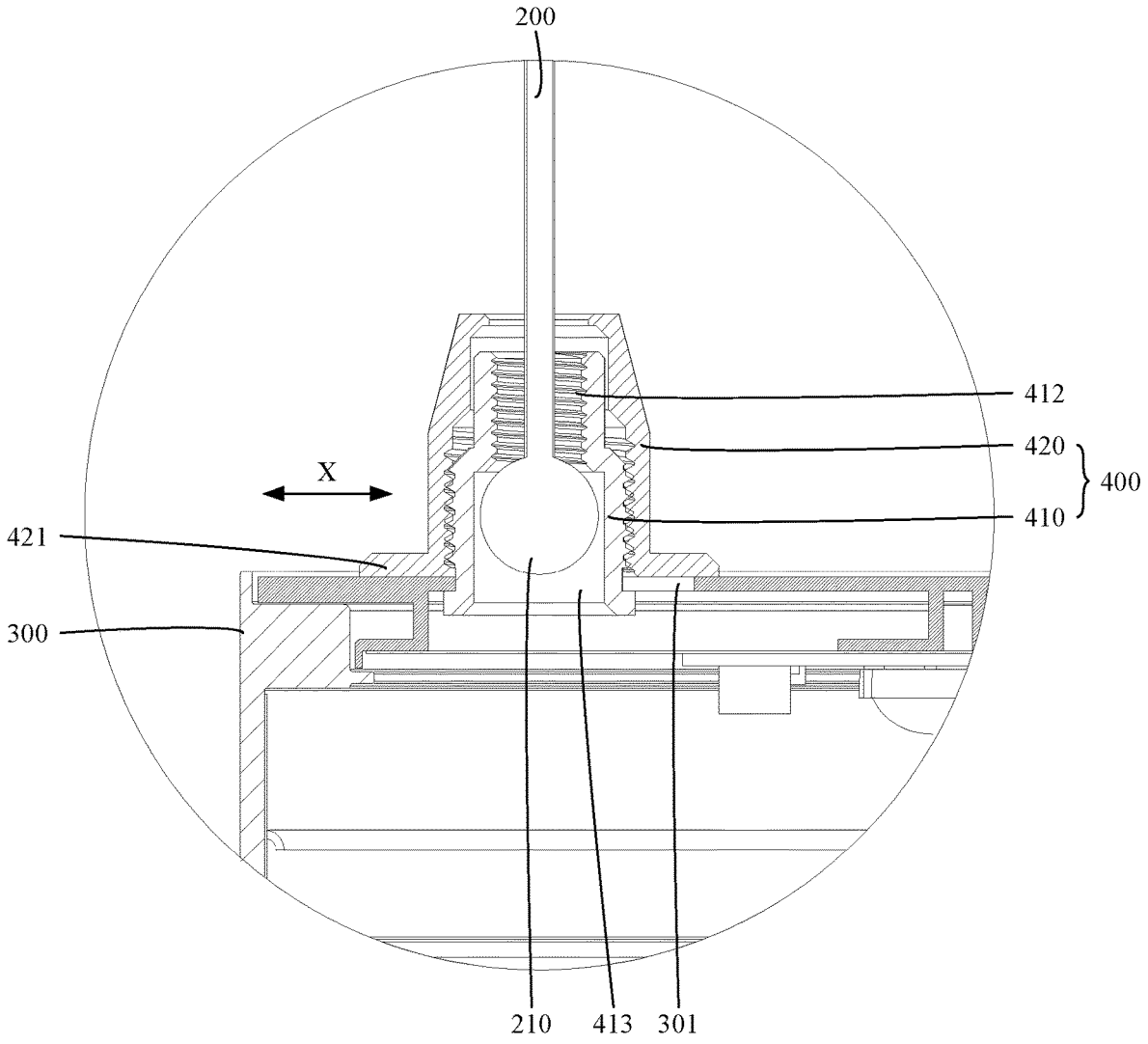
Figure 8:
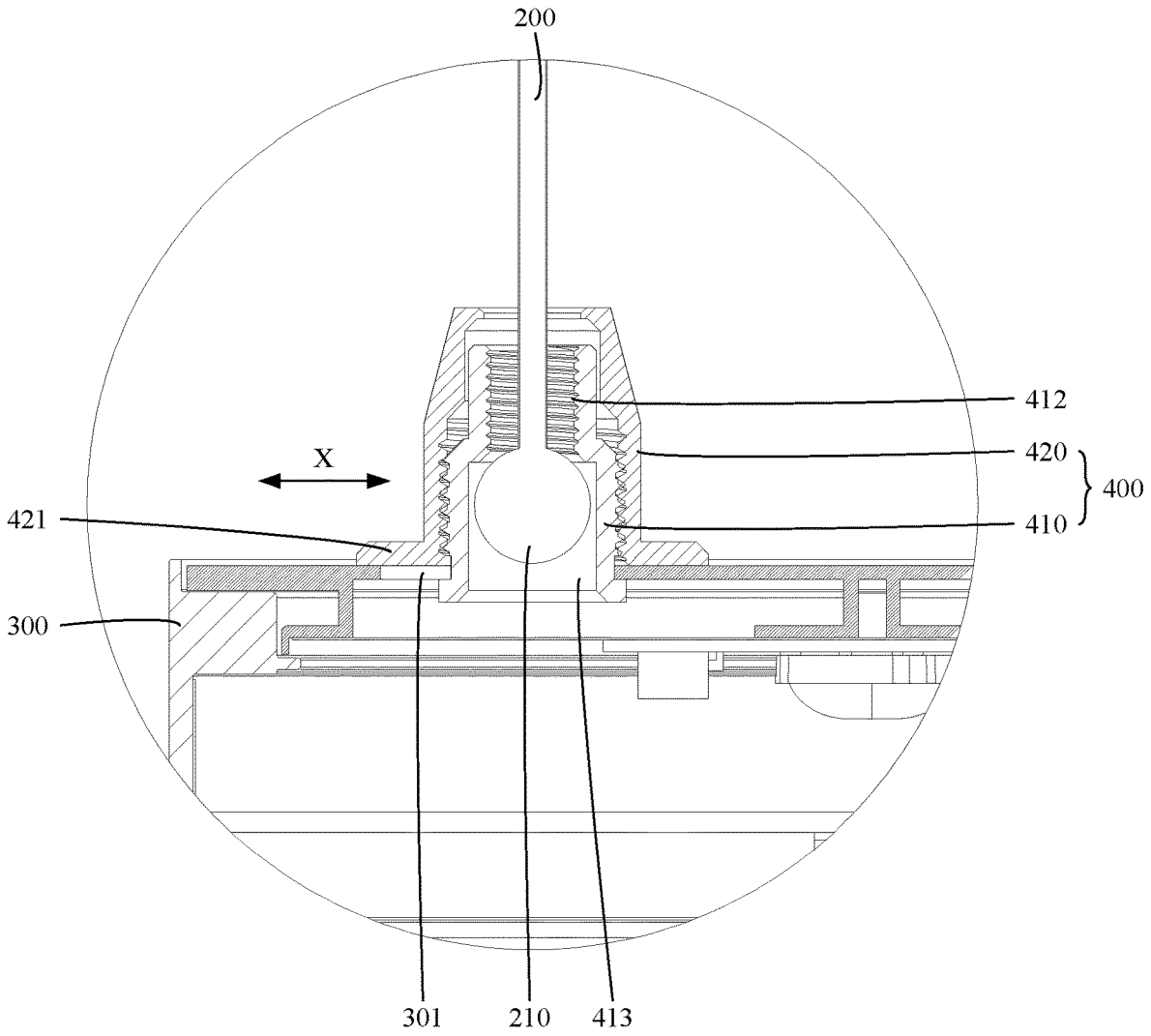

In order to make objects, technical details and advantages of the present disclosure more clearly, the technical solutions of the examples will be described in a clearly and fully understandable way in connection with the drawings related to the examples of the present disclosure. Apparently, the described examples are just a part but not all of the examples of the present disclosure. Based on the described examples herein, those skilled in the art can obtain other example(s), without any inventive work, which should be within the scope of the present disclosure.

The present disclosure provides:

100—fixing portion,

200—suspension wire, 210—limiting protrusion,

300—lamp body, 301—strip-shaped adjusting hole, 310—first light-emitting unit, 320—second light-emitting unit,

400—adjusting component, 410—supporting member, 411—first limiting flange, 412—threaded hole, 413—limiting groove, 414—first threaded section, 415—second threaded section, 416—first plane section, 417—second plane section, 420—locking member, 421—second limiting flange,

500—wire locker,

600—equalizing bar.

The lighting lamp usually includes a fixing portion, a suspension wire and a lamp body. The fixing portion is configured to install the suspension wire and the lamp body. The fixing portion is usually fixed on the roof of the house, and the lamp body is connected to the fixing portion by the suspension wire. The lighting lamps are popular with people because of their simple structure and good appearance.

However, due to errors in the manufacturing process of various parts of the lamp body, or errors in the assembly process of the lamp body and the suspension wire, the center of gravity of the lamp body for example is shifted. Therefore, the connection position of the lamp body and the suspension wire may deviate from the position of the center of gravity of the lamp body, so that the lamp body is prone to deflection when the lighting lamp illuminates, thereby affecting the performance of the lighting lamp.

As shown in FIG. 1 to FIG. 11, examples of the present disclosure disclose a lighting lamp, and the lighting lamp for example includes a fixing portion 100, a suspension wire 200, a lamp body 300 and an adjusting component 400.

The fixing portion 100 is configured to install the lamp body 300 and the suspension wire 200, the fixing portion 100 is usually installed on the roof of a house. The fixing portion 100 for example is provided with a driver for driving a light source module in the lamp body 300 to work, and the driver is electrically connected to the light source module in the lamp body 300 through a conductive wire. The light source module for example is an LED (Light Emitting Diode) or a gas light emitting module, which is not limited in the present disclosure. The suspension wire 200 for example is a steel suspension wire or a conductive wire. The specific type of the suspension wire 200 is not limited in the present disclosure.

The lamp body 300 is provided with a strip-shaped adjusting hole 301, an extending direction of the strip-shaped adjusting hole 301 is perpendicular to an extending direction of the suspension wire 200, the adjusting component 400 includes a supporting member 410 and a locking member 420, and the supporting member 410 is connected to the lamp body 300 and is configured to support and hang the lamp body 300. A first end of the supporting member 410 and the lamp body 300 are slidingly fitted with each other along the extending direction of the strip-shaped adjusting hole 301, a second end of the supporting member 410 passes through the strip-shaped adjusting hole 301 and is movably connected with the locking member 420, a lamp body clamping space is formed between the first end of the supporting member 410 and the locking member 420, and the lamp body clamping space is configured to fix the relative position of the supporting member 410 and the lamp body 300. One end of the suspension wire 200 is connected to the fixing portion 100, and the other end of the suspension wire 200 is connected to the supporting member 410.

In this case, when the supporting member 410 and the locking member 420 are both in contact with the lamp body 300, at least a part of the lamp body 300 is located in the lamp body clamping space formed by the first end of the supporting member 410 and the locking member 420, and the supporting member 410 and the locking member 420 clamp the lamp body 300, so that the lamp body 300 and the supporting member 410 cannot move relative to each other, thereby fixing the position of the lamp body 300; when the locking member 420 is separated from the lamp body 300, the supporting member 410 and the lamp body 300 are movable relative to each other along the extending direction of the strip-shaped adjusting hole 301, thereby adjusting the position of the lamp body 300. Optionally, the supporting member 410 and the locking member 420 for example is connected by a snap-fit connection or a threaded connection.

In the examples of the present disclosure, the supporting member 410 and the lamp body 300 are slidingly fitted with each other along the extending direction of the strip-shaped adjusting hole 301. In this case, the position of the lamp body 300 can be adjusted along the extending direction of the strip-shaped adjusting hole 301. After the installation position of the lamp body 300 is adjusted to be horizontal, the locking member 420 locks the lamp body 300 and the supporting member 410 to fix the relative position of the lamp body 300 and the supporting member 410. This solution can adjust the connection position of the lamp body 300 and the suspension wire 200 to adjust the center of gravity of the lamp body 300, thereby keeping the installation position of the lamp body 300 to be horizontal, thereby improving the performance of the lighting lamp.

Optionally, the lighting lamp for example is a chandelier with a single suspension line, a chandelier with two suspension lines, or a chandelier with multiple suspension lines. The specific type of the lighting lamp is not limited herein.

Optionally, the extending direction of the strip-shaped adjusting hole 301 for example is parallel to a length direction of the lamp body 300 or perpendicular to the length direction of the lamp body 300.

In an alternative example, the supporting member 410 for example is provided with a first limiting flange 411. In this case, the first limiting flange 411 is in position-limiting fit with an inner wall of the strip-shaped adjusting hole 301 in the extending direction of the suspension wire 200, and the supporting member 410 is not easy to slip out of the strip-shaped adjusting hole 301, thereby improving the safety of the lighting lamp. Further, the locking member 420 for example is provided with a second limiting flange 421. The first limiting flange 411 and the second limiting flange 421 are arranged in the extending direction of the suspension wire 200, and the lamp body clamping space is formed between the first limiting flange 411 and the second limiting flange 421. In this case, the first limiting flange 411 and the second limiting flange 421 cooperate with each other to clamp the lamp body 300, so that the lamp body 300 can be held in the installation position more stably. In addition, this fitting method is simple, reliable, and easy to implement.

In an alternative example, the locking member 420 for example is provided with a first snap-fit portion, the supporting member 410 for example is provided with a second snap-fit portion, and the first snap-fit portion is snap-fitted with the second snap-fit portion. In this case, the snap-fit cooperation between the locking member 420 and the supporting member 410 clamp and fix the lamp body 300. In this solution, the locking member 420 and the supporting member 410 are connected in a simple and convenient manner and are easy to operate, and the first snap-fit portion and the second snap-fit portion are simple to manufacture, so that the cost of the lighting lamp is lower.

In order to improve the safety and reliability of the lighting lamp, in an alternative example, the locking member 420 is sleeved on an outside of the supporting member 410, and the locking member 420 is threadedly connected with the supporting member 410. In this case, the locking member 420 and the supporting member 410 receive less force during the screwing process, so the locking member 420 and the supporting member 410 are not easy to be damaged, thereby prolonging the service life of the adjusting component 400, and thereby improving the safety and reliability of the lighting lamp. Optionally, the locking member 420 for example is provided with a threaded hole 412, an outer circumferential surface of the supporting member 410 for example is provided with an external thread, and the external thread of the supporting member 410 is threadedly connected with the threaded hole 412 of the locking member 420.

In order to improve the adjustment accuracy of the supporting member 410, in another example, the outer circumferential surface of the supporting member 410 includes a first threaded section 414, a first plane section 416, and a second threaded section 415 and a second plane section 417 which are sequentially connected with one another; the first threaded section 414 and the second threaded section 415 are arranged opposite to each other; in a direction perpendicular to the extending direction of the strip-shaped adjusting hole 301, the first plane section 416 and the second plane section 417 are arranged opposite to each other; and the first threaded section 414 and the second threaded section 415 are both threadedly fitted with the locking member 420. In this case, the area of the contact surface between the first plane section 416 as well as the second plane section 417 and the side wall of the strip-shaped adjusting hole 301 is relatively large, so that the supporting member 410 is not easy to scratch the the side wall of the strip-shaped adjusting hole 301, thereby improving the adjustment accuracy of the supporting member 410.

At the same time, the first plane section 416 and the second plane section 417 also have a guiding function, so that the supporting member 410 can move more accurately along the extending direction of the strip-shaped adjusting hole 301, and so that the supporting member 410 is not prone to deflection during moving.

Figure 9:
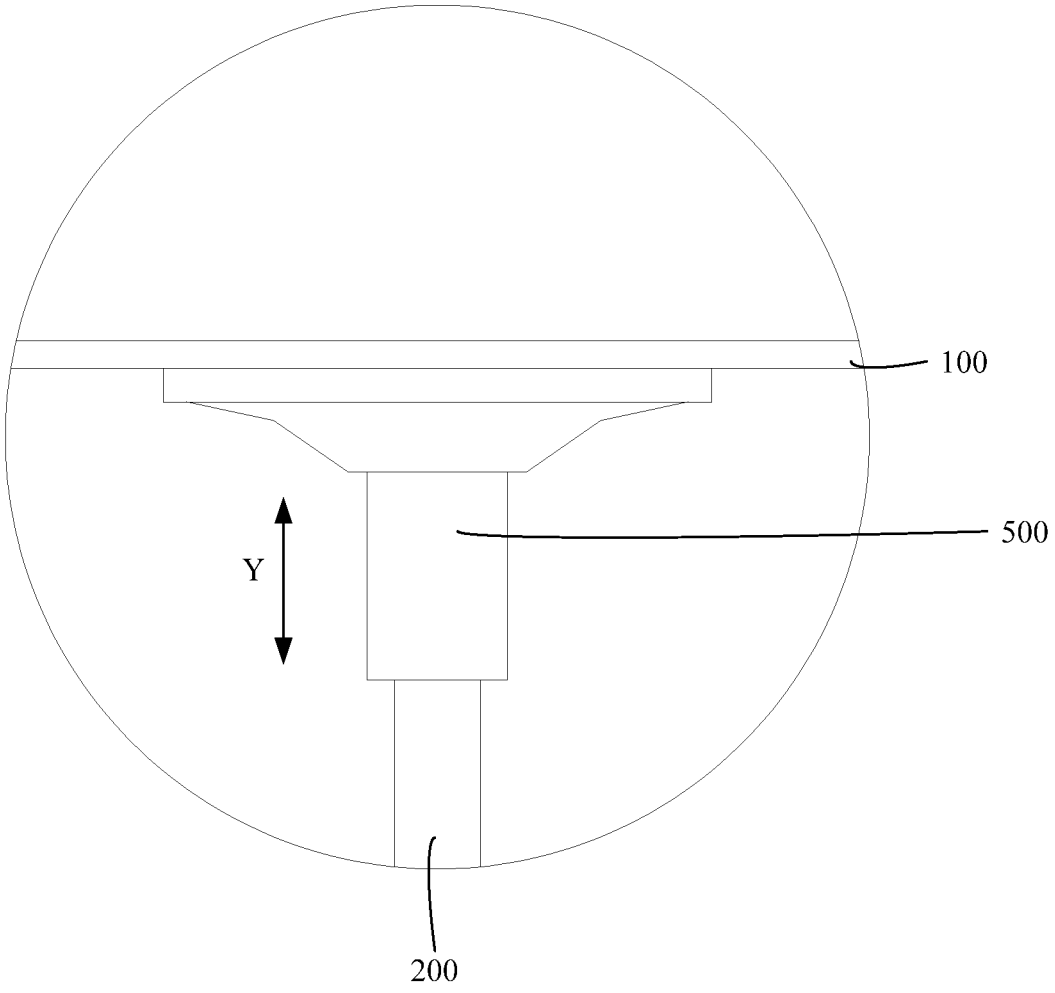
FIG. 9 is a schematic diagram of a partial enlarged view of the lighting lamp according to the examples of the present disclosure.
Figure 10:
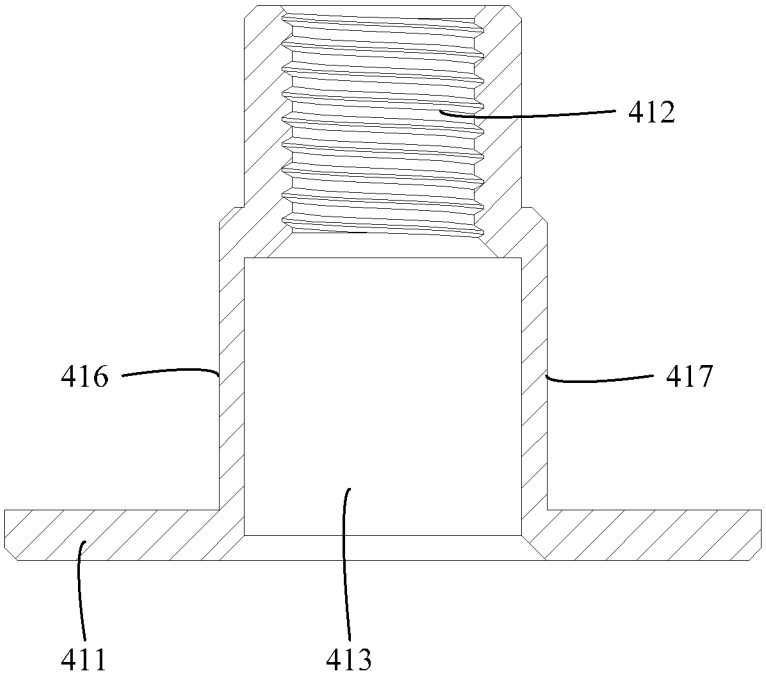
FIG. 10 is a schematic diagram of a cross-sectional view of a supporting member in the lighting lamp according to the examples of the present disclosure.
Figure 11:
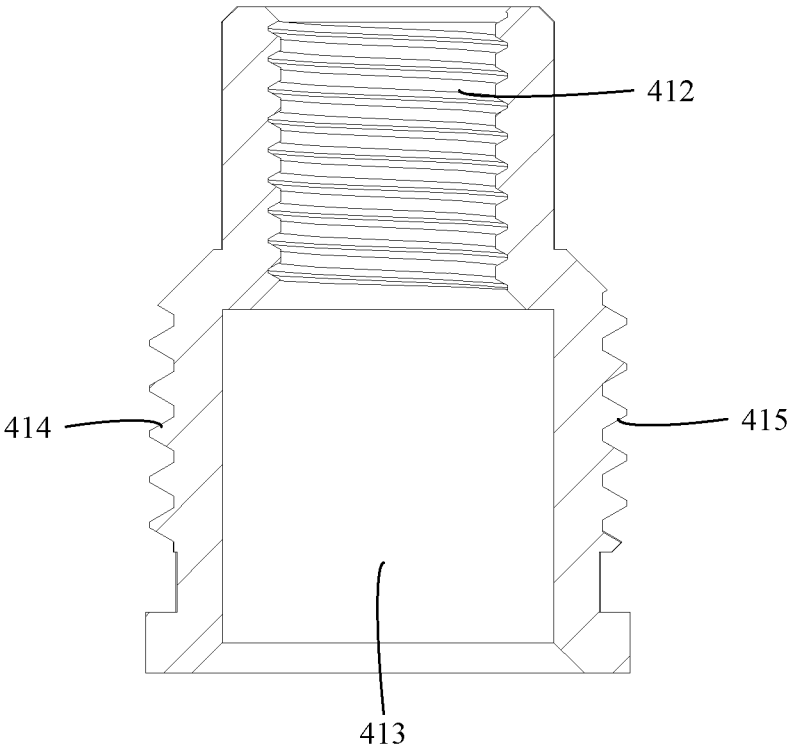
FIG. 11 is a schematic diagram of a cross-sectional view of the supporting member in another direction in the lighting lamp according to the examples of the present disclosure.

In the above examples, in order to make the installation position of the lamp body 300 in its own length direction to be horizontal, the height of an end of the lamp body 300 is adjusted by adjusting the length of the suspension wire 200, so that two ends of the lamp body 300 can be kept horizontal (the adjustment direction of the suspension wire length is the direction shown by Y in FIG. 9). However, it is difficult to make the installation position of the lamp body 300 in its own width direction to be horizontal by adjusting the length of the suspension wire 200. The width direction of the lamp body 300 is perpendicular to the length direction of the lamp body 300 and perpendicular to the extending direction of the suspension wire 200. In an optional example, the extending direction of the strip-shaped adjusting hole 301 for example is perpendicular to the length direction of the lamp body 300 and perpendicular to the extending direction of the suspension wire 200 (the direction shown by X in FIG. 5 to FIG. 8). In this case, the extending direction of the strip-shaped adjusting hole 301 is the width direction of the lamp body 300, so the lamp body 300 can be adjusted in the width direction of the lamp body 300, so that the installation position of the lamp body 300 is horizontal in the width direction of the lamp body 300.

The present disclosure provides a specific structure for adjusting the length of the suspension wire 200. Of course, other structural forms may also be adopted, which is not limited by the present disclosure. Specifically, the lighting lamp for example further includes a wire locker 500, and the suspension wire 200 and the fixing portion 100 are connected with each other by the wire locker 500. In this case, when the user needs the suspension wire 200 to be shorter, the user holds the suspension wire 200 and pushes the suspension wire 200 toward the wire locker 500, so that the suspension wire 200 enters the wire locker 500, and the wire locker 500 is provided with a holding device to fix the suspension wire 200 and prevent the suspension wire 200 from moving; when the user needs the suspension wire 200 to be longer, the user holds the suspension wire 200 and pull the suspension wire 200 toward the lamp body 300, so as to withdraw the suspension wire 200 from the wire locker 500. In this case, the installation height of the lamp body 300 can be adjusted, and at the same time, the installation position of the lighting lamp can be kept horizontal in the length direction of the lamp body 300. This method is simple, reliable, and easy to operate. The wire locker 500 is a well-known technology and will not be described in detail here.

In the above examples, since a cross-sectional area of the suspension wire 200 is small, a connection position between the suspension wire 200 and the supporting member 410 is easy to deviate from the position of the center of gravity of the lighting lamp when the suspension wire 200 is connected to the supporting member 410, resulting in a deviation in the connection position of the suspension wire 200 and the connection member, thereby causing the lighting lamp to be tilted during installation. In another example, the lighting lamp disclosed in the present disclosure for example further includes an equalizing bar 600, the equalizing bar 600 is sleeved on the suspension wire 200, and an end of the equalizing bar 600 is connected to the supporting member 410. In this case, a cross-sectional area of the equalizing bar 600 is larger, so that the area of the contact surface at the connection between the equalizing bar 600 and the suspension wire 200 is larger, thereby the suspension wire 200 and the supporting member 410 are not easy to deviate from the position of the center of gravity of the lighting lamp, thereby preventing the lighting lamp from being deflected during assembly. At the same time, the rigidity of the connection between the equalizing bar 600 and the supporting member 410 is relatively large, so that the lamp body 300 is not easy to shake.

In addition, an outer surface of the equalizing bar 600 for example is decorated, so that the aesthetics appearance of the lighting lamp can be improved, and the user experience can be improved.

Optionally, the outer circumferential surface of the supporting member 410 for example is provided with threads, and an end of the equalizing bar 600 for example is provided with threaded holes; because the end of the equalizing bar 600 needs to be machined with threaded holes, the cross-sectional area of the equalizing bar 600 is larger, which results in a larger volume of the equalizing bar 600, so that the aesthetics appearance of the lighting lamp may be adversely affected. Therefore, it is desired that the supporting member 410 is provided with a threaded hole 412, the end of the equalizing bar 600 has an external thread, and the end of the equalizing bar 600 is threadedly connected to the threaded hole 412. In this case, the external thread is machined on the outer circumferential surface of the equalizing bar 600. As a result, the cross-sectional area of the equalizing bar 600 is small, and the volume of the equalizing bar 600 is small, so that the aesthetics appearance of the lighting lamp is better, thereby improving the user experience.

In an alternative example, the lamp body 300 for example includes a first light-emitting unit 310 and a second light-emitting unit 320; each of the first light-emitting unit 310 and the second light-emitting units 320 has a light-emitting surface; in the extending direction of the suspension wire 200, the first light-emitting unit 310 and the second light-emitting unit 320 are sequentially stacked; the light-emitting surface of the first light-emitting unit 310 faces the second light-emitting unit 320; and the first light-emitting unit 310 is provided with the strip-shaped adjusting hole 301. In this case, the lighting lamp has two light-emitting units for emitting light, so that the area of the light-emitting surface of the lighting lamp is increased, the brightness of the lighting lamp increases, and the illumination range of the lighting lamp increases, thereby expanding the usage scenarios of the lighting lamp. In addition, this design can make the lighting lamp more enjoyable. The type of the first light-emitting unit 310 and the second light-emitting unit 320 for example is a flat light or a downlight. The specific types of the first light-emitting unit 310 and the second light-emitting unit 320 are not limited herein.

In order to further increase the application scenarios of the lighting lamp, in another example, the second light-emitting unit 320 and the first light-emitting unit 310 are slidably connected with each other. In this case, by adjusting the relative position between the second light-emitting unit 320 and the first light-emitting unit 310, the illumination range of the lighting lamp can be adjusted, so that the lighting lamp can be applied to a variety of lighting scenarios.

For example, the first light-emitting unit 310 and the second light-emitting unit 320 for example are staggered along the length direction of the lamp body 300, or are staggered along the width direction of the lamp body 300, or are staggered in the length direction and width direction of the lamp body 300. For example, the second light-emitting unit 320 is slidable along the length direction of the lamp body 300, or the second light-emitting unit 320 is slidable along the width direction of the lamp body 300. During the sliding process of the second light-emitting unit 320, the brightness of the lighting lamp is adjusted by the second light-emitting unit 320 shielding at least a part of the light-emitting surface of the first light-emitting unit 310. When the exposed area of the light-emitting surface of the first light-emitting unit 310 is relatively large, the lighting lamp is used in a mode that requires high lighting conditions; when the exposed area of the light-emitting surface of the first light-emitting unit 310 is small, the lighting lamp is used in a mode with lower lighting conditions (for example, night light mode). Therefore, the usage scenarios of lighting lamp are increased.

Optionally, one of the first light-emitting unit 310 and the second light-emitting unit 320 is provided with a sliding rail, and the other is provided with a sliding protrusion, and the sliding rail and the sliding protrusion are slidingly fitted. The sliding rail for example is an external guide rail, or for example is a sliding groove provided at the housing of the first light-emitting unit 310 or the second light-emitting unit 320.

The second light-emitting unit 320 moves relative to the first light-emitting unit 310. If the second light-emitting unit 320 exceeds the moving stroke, the second light-emitting unit 320 and the first light-emitting unit 310 may be separated from each other, thereby reducing the safety and reliability of the lighting lamp. To this end, in another example, the first light-emitting unit 310 for example is provided with a first limiting portion, the second light-emitting unit 320 for example is provided with a second limiting portion, and in the sliding direction of the second light-emitting unit 320, the first limiting portion and the second limiting portion are in position-limiting fit. In this case, the first limiting portion and the second limiting portion prevent the stroke of the second light-emitting unit 320 from exceeding the adjustable range, thereby improving the safety and reliability of the lamp. Optionally, in the case that one of the first light-emitting unit 310 and the second light-emitting unit 320 is provided with the sliding rail and the other is provided with the sliding protrusion, both ends of the sliding rail are provided with the first limiting portions, and both ends of the sliding protrusion are provided with the second limiting portions. The first limiting portion for example is a protrusion, and the second limiting portion for example is a groove; or, both the first limiting portion and the second limiting portion are protrusions.

Optionally, an end of the suspension wire 200 for example is provided with a first threaded connecting portion, and the supporting member 410 for example is provided with a second threaded connecting portion. The first threaded connecting portion and the second threaded connecting portion are threadedly connected, so as to realize the connection between the suspension wire 200 and the supporting member 410. However, when an end of the lamp body 300 is inclined, a relatively large force occurs between the first threaded connecting portion and the second threaded connecting portion, which may easily cause the tooth-type crack of the first threaded connecting portion and the second threaded connecting portion, thereby reducing the safety and reliability of the lighting lamp.

To solve the above problem, in another example, an end of the suspension wire 200 for example is provided with a limiting protrusion 210, and the supporting member 410 for example is provided with a limiting groove 413, and in the extending direction of the suspension wire 200, the limiting protrusion 210 and the limiting groove 413 are in position-limiting fit. In this case, through the size interference between the limiting protrusion 210 and the limiting groove 413, the connection between the suspension wire 200 and the support 410 is realized. The degree of freedom between the limiting protrusion 210 and the limiting groove 413 is relatively large; when an end of the lamp body 300 is inclined, the limiting protrusion 210 and the limiting groove 413 move relative to each other, thereby adjusting the relative position between the limiting protrusion 210 and the limiting groove 413, so that the limiting protrusion 210 and the limiting groove 413 receive a relatively small force. Therefore, the connection reliability between the suspension wire 200 and the supporting member 410 is high, so that the safety and reliability of the lighting lamp are high.

Optionally, the limiting protrusion 210 for example has a spherical structure, and the spherical structure has a greater freedom, so that the relative position between the limiting protrusion 210 and the limiting groove 413 can be changed more flexibly to adapt to the installation process of the lighting lamp. Of course, the limiting protrusion 210 may also be a disc-shaped structure, and the shape of the limiting groove 413 fits the shape of the limiting protrusion 210. The specific shapes of the limiting groove 413 and the limiting protrusion 210 are not limited herein.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The following beneficial technical effects can be achieved by the technical solution provided by the disclosure.

In the lighting lamp provided by the disclosure, the lamp body is provided with the strip-shaped adjusting hole, the supporting member and the lamp body are slidingly fitted with each other along the extending direction of the strip-shaped adjusting hole; and in this case, the position of the lamp body can be adjusted along the extending direction of the strip-shaped adjusting hole. After the installation position of the lamp body is adjusted to be horizontal, the locking member locks the lamp body and the supporting member to fix the relative position of the lamp body and the supporting member. This solution can adjust the connection position of the lamp body and the suspension wire to adjust the center of gravity of the lamp body, thereby keeping the installation position of the lamp body to be horizontal, and thereby improving the performance of the lighting lamp.

In the above examples of the present disclosure, the focus is on the differences between the various examples. As long as the different optimization features among the various examples are not contradictory, they can be combined to form a more example. Considering the succinct writing, those are not repeated here.

The foregoing is only the examples of the present disclosure and is not intended to limit the present disclosure. It will be apparent to those skilled in the art that various modifications and variations can be made in the present disclosure. Any modification, equivalent substitution, improvement, etc. within the spirit and principle of the present disclosure should be included in the scope of the present disclosure.

What is claimed is:

1. A lighting lamp, comprising: a fixing portion, a suspension wire, a lamp body and an adjusting component, wherein:

the lamp body is provided with a strip-shaped adjusting hole, an extending direction of the strip-shaped adjusting hole is perpendicular to an extending direction of the suspension wire, the adjusting component comprises a supporting member and a locking member, a first end of the supporting member and the lamp body are slidingly fitted with each other along the extending direction of the strip-shaped adjusting hole, a second end of the supporting member passes through the strip-shaped adjusting hole and is movably connected with the locking member, a lamp body clamping space is formed between the first end of the supporting member and the locking member, one end of the suspension wire is connected to the fixing portion, the other end of the suspension wire is connected to the supporting member, an end of the suspension wire is provided with a limiting protrusion, and the limiting protrusion has a spherical structure that allows the relative movement of supporting member and the limiting protrusion in the extending direction.

2. The lighting lamp according to claim 1, wherein the supporting member is provided with a first limiting flange, the locking member is provided with a second limiting flange, the first limiting flange and the second limiting flange are arranged in the extending direction of the suspension wire, and the lamp body clamping space is formed between the first limiting flange and the second limiting flange.

3. The lighting lamp according to claim 2, wherein the locking member is sleeved on an outside of the supporting member, and the locking member is threadedly connected with the supporting member.

4. The lighting lamp according to claim 3, wherein an outer circumferential surface of the supporting member comprises a first threaded section, a first plane section, a second threaded section and a second plane section which are sequentially connected with one another; the first threaded section and the second threaded section are arranged opposite to each other; in a direction perpendicular to the extending direction of the strip-shaped adjusting hole, the first plane section and the second plane section are arranged opposite to each other; and the first threaded section and the second threaded section are both threadedly fitted with the locking member.

5. The lighting lamp according to claim 2, wherein the locking member is provided with a first snap-fit portion, the supporting member is provided with a second snap-fit portion, and the first snap-fit portion is snap-fitted to the second snap-fit portion.

6. The lighting lamp according to claim 1, wherein the extending direction of the strip-shaped adjusting hole is perpendicular to a length direction of the lamp body and is perpendicular to the extending direction of the suspension wire.

7. The lighting lamp according to claim 1, wherein the lighting lamp further comprises a wire locker, and the suspension wire and the fixing portion are connected with each other by the wire locker.

8. The lighting lamp according to claim 1, wherein the lighting lamp further comprises an equalizing bar, and an end of the equalizing bar is connected to the supporting member.

9. The lighting lamp according to claim 8, wherein the supporting member is provided with a threaded hole, an end of the equalizing bar has an external thread, and the end of the equalizing bar is threadedly connected with the threaded hole.

10. The lighting lamp according to claim 1, wherein the lamp body comprises a first light-emitting unit and a second light-emitting unit; each of the first light-emitting unit and the second light-emitting units has a light-emitting surface; in the extending direction of the suspension wire, the first light-emitting unit and the second light-emitting unit are sequentially stacked; the light-emitting surface of the first light-emitting unit faces the second light-emitting unit, and the first light-emitting unit is provided with the strip-shaped adjusting hole.

11. The lighting lamp according to claim 10, wherein the second light emitting unit is slidably connected to the first light emitting unit.

12. The lighting lamp according to claim 11, wherein the first light-emitting unit is provided with a first limiting portion, and the second light-emitting unit is provided with a second limiting portion; and in a sliding direction of the second light-emitting unit, the first limiting portion and the second limiting portion are in position-limiting fit.

13. The lighting lamp according to claim 1, wherein the supporting member is provided with a limiting groove; and in the extending direction of the suspension wire, the limiting protrusion and the limiting groove are in position-limiting fit.

* * * * *